US006086638A

United States Patent [19]

Horiguchi et al.

[11] Patent Number: 6,086,638

[45] Date of Patent: Jul. 11, 2000

[54] METHOD FOR DYEING A POLYAMIDE FABRIC IN A GRANDRELLE TONE, AND A DYED FABRIC OBTAINED BY SAID METHOD

[75] Inventors: Tomoyuki Horiguchi, Kyoto; Yutaka Masuda, Shiga; Katsuhiko Mochizuki, Shizuoka, all of Japan

[73] Assignee: Toray Industries, Inc., Japan

[21] Appl. No.: 09/284,028

[22] PCT Filed: Sep. 16, 1998

[86] PCT No.: PCT/JP98/04163

§ 371 Date: Apr. 6, 1999

§ 102(e) Date: Apr. 6, 1999

[87] PCT Pub. No.: WO99/15726

PCT Pub. Date: Apr. 1, 1999

[30] Foreign Application Priority Data

Sep. 19, 1997 [JP] Japan ..... 9-254789

[51] Int. Cl.[7] ..... D06P 3/82; C09B 62/04

[52] U.S. Cl. ..... 8/531; 8/543; 8/549; 8/924; 8/478; 8/529; 428/399; 442/60; 442/203

[58] Field of Search ..... 8/478–484, 543, 8/549, 529, 531; 428/399; 442/60, 203

[56] References Cited

U.S. PATENT DOCUMENTS

| | | |
|---|---|---|
| 3,591,672 | 7/1971 | Davies et al. . |
| 4,778,919 | 10/1988 | Töpfe . |
| 5,810,890 | 9/1998 | Russ et al. . |

FOREIGN PATENT DOCUMENTS

| | | |
|---|---|---|
| 52103523 | of 0000 | Japan . |
| 55016930 | of 0000 | Japan . |
| 62191510 | of 0000 | Japan . |
| 62205050 | of 0000 | Japan . |
| 63211335 | of 0000 | Japan . |
| 7097777 | of 0000 | Japan . |
| 7-097777 | 11/1995 | Japan . |

OTHER PUBLICATIONS

Burkinshaw, S. M. and Wills, A. E., "The Dyeing of Conventional and Microfibre Nylon 6, 6 with Reactive Dyes —3. Vinyl Sulphone and Chlorotriazine Dyes", Dyes and Pigments, vol. 34, No. 3, pp. 243–253, 1997.

Burkinshaw, S. M. and Gandhi, K., "The Dyeing of Conventional and Microfibre Nylon 6, 6 with Reactive Dyes. Part 2. –Bromoacrylamido Dyes", Dyes and Pigments, vol. 33, No. 4, pp. 259–280, 1997.

Burkinshaw, S. M. et al., "Dyeing Nylon 6, 6 with Monochlorotriazine/Sulphatoethylsulphone Hetero Bifunctional Reactive Dyes", Book PAP International Conference Exhibit AATCC, pp. 471–475, 1997.

Lewis, David M. and MacDougall, W. Craig, "Dyeing Nylon 6, 6 with Vinylsulfone Reactive Dyes", Textile Chemist and Colorist, May 1998, pp. 31–35.

Burkinshaw, S. M. and Gandhi, K., "The Dyeing of Conventional Decitex and Microfibre Nylon 6, 6 with Reactive Dyes —I. Chlorodifluoropyrimidinyl Dyes", Dyes and Pigments, vol. 32, No. 2, pp. 101–127, 1996.

Burkinshaw, S. M. and Wills, A. E., "The Effect of PH on the Dyeing of Conventional and Microfibre Nylon with Chlorotriazine and Vinyl Sulphone Reactive Dyes", AATCC Congress Book PAP, pp. 520–531, 1996.

Lewis, David M. and MacDougall, W. Craig, "Dyeing Nylon 6, 6 with Vinylsulphone Reactive Dyes", AATCC Congress Book PAP, pp. 284–295, 1996.

*Primary Examiner*—Margaret Einsmann
*Attorney, Agent, or Firm*—Austin R. Miller

[57] ABSTRACT

The method for dyeing a polyamide fabric of the present invention comprises the step of dyeing a polyamide fabric having structural variations in the longitudinal direction of the fibers, by a dye liquor containing an anionic reactive dye and regulated at pH 3~8. The dyed product of the present invention is a dyed polyamide fabric obtained by said dyeing method. Furthermore, the dyed product of the present invention is obtained as a grandrelle tone dyed product by dyeing a polyamide fabric having structural variations in the longitudinal direction of the fibers by a reactive dye, and being 4th or higher grade in the wash fastness specified in JIS L-0844.

The present invention can provide a method for dyeing a polyamide fabric in a clear high grade grandrelle tone and to have excellent wash fastness, and also a grandrelle tone dyed product.

11 Claims, No Drawings

METHOD FOR DYEING A POLYAMIDE FABRIC IN A GRANDRELLE TONE, AND A DYED FABRIC OBTAINED BY SAID METHOD

TECHNICAL FIELD

The present invention relates to a method for dyeing a polyamide fabric in a high grade grandrelle tone to have excellent wash fastness, and a grandrelle tone dyed fabric obtained by said method.

BACKGROUND ARTS

Attempts have been made to give natural irregular color tones as can be seen in wool and hemp to synthetic fiber fabrics, or to obtain new visual effects by coloring fine color dots. For example, the following means are available.

(1) Yarns dyed in different colors are woven together to form a fabric.

(2) Fibers having different dyeing properties are woven together to form a fabric, and the fabric is dyed.

(3) Spot patterns, as many as the number of colors, are printed by roller printing or screen printing, etc.

(4) Particles containing dyes are applied to a fabric for coloring.

(5) Fibers with structural variations are dyed.

Of these means, those which can express natural color shade variations called a grandrelle tone or sprinkly colored tone are mainly (3) and (5), but (3) has a problem that it involves trouble and cost for engraving the roll or manufacturing the screen printing plate. On the other hand, if fibers, for example, having thickness variations as structural variations of (5) are dyed by any ordinary method, thick portions are dyed darkly while thin portions are dyed lightly. So, (5) is said to be promising as a means for expressing a grandrelle tone since a natural irregular color tone can be given.

Synthetic fibers having thickness variations in the longitudinal direction of the fibers include polyester fibers, polyamide fibers, etc. Methods for producing polyester fibers are proposed in Japanese Patent Laid-Open (Kokai) Nos. 52-103523, 55-16930, etc. Methods for producing polyamide fibers are proposed in Registration No. 2572035, Japanese Patent Laid-Open (Kokai) No. 63-211335, etc.

These fibers can be dyed to have color shade variations. However, polyamide fibers cannot clearly manifest color shade variations, and compared to ordinary polyamide fibers, they have a problem of declining in wash fastness. That is, when a polyamide fabric having fiber thickness variations is dyed, an acid dye generally used for any ordinary polyamide fabric is used. However, when polyamide is dyed by an acid dye, the dye migrates, making it difficult to clearly express the so-called grandrelle tone peculiar to fibers having thickness variations. Furthermore, if fibers with such structural variations are dyed by an acid dye, the wash fastness of the dyed fabric declines. So, to keep fastness, the crystallinity must be intentionally raised, which lessens the structural variations.

To improve the grandrelle tone, the color shade variations can be intensified by increasing the sectional area ratio of thick portions to thin portions, but the dyed product obtained has deep dyed stripes and cannot have a high grade grandrelle tone. Furthermore, the dyed product obtained by using a fabric intensified in fiber thickness variations declines further in wash fastness disadvantageously.

Against this technical background, a dyeing technique to assure an intensive grandrelle tone and excellent wash fastness is being demanded.

Furthermore, the inventors found that for dyeing a polyamide fabric having fiber thickness variations in a grandrelle tone, if the premetalized dye has poor dye leveling property compared to an acid dye, the grandrelle tone can be intensified to some extent while wash fastness can also be improved. However, the grade of the grandrelle tone is poor, and the premetalized dye is dark in hue and cannot express a clear color.

On the other hand, it is publicly known that a reactive dye can dye an ordinary polyamide fabric. For example, Japanese Patent Laid-Open (Kokai) No. 7-97777 discloses a method of dyeing polyamide fibers by a reactive dye in an acid to neutral bath. However, practically, polyamide fibers dyed by a reactive dye have often irregular stripes, etc. disadvantageously, and a reactive dye is not practically applied since the application of a reactive dye for polyamide fibers has no advantage compared to the use of a conventional acid dye free from the problem. In this situation, it is not known at all that a grandrelle tone with clear color shade variations can be obtained by dyeing a polyamide fabric with structural variations in the longitudinal directions of the fibers using an anionic reactive dye.

DISCLOSURE OF THE INVENTION

The present invention provides a method for dyeing a polyamide fabric in a high grade clear grandrelle tone to achieve excellent wash fastness and light fastness, and also a grandrelle tone dyed product.

The present invention provides a method for dyeing a polyamide fabric, comprising the step of dyeing a polyamide fabric having structural variations in the longitudinal direction of the fibers by use of a dye liquor containing an anionic reactive dye, regulated at pH 3~8, and also provides a dyed polyamide fabric obtained by said dyeing method.

The dyed product of the present invention is obtained as a polyamide fabric having structural variations in the longitudinal direction of the fibers and dyed by a reactive dye, ranking at the 4th or higher grade in wash fastness as specified by JIS L-0844.

THE BEST EMBODIMENTS OF THE INVENTION

The polyamide fibers having structural variations in the longitudinal direction of the fibers refer to a polyamide fabric having fiber thickness variations and/or crystallinity variations.

The polyamide fibers in the present invention refer to the fibers of a polymer with amide bonds such as nylon 4, nylon 6 or nylon 66, etc.

The fabric is not especially limited, and can be yarn, woven fabric, knitted fabric, nonwoven fabric or artificial leather, etc. A woven fabric or a knitted fabric can be preferably used since a good appearance can be obtained. In addition to the polyamide fibers having structural variations in the longitudinal direction of the fibers, the fabric can also contain synthetic fibers of an ordinary polyamide, polyester, polyurethane or acrylic resin or natural fibers of wool, silk or cellulose, etc.

The fiber thickness variations in the present invention refer to variations in the sectional area of fibers in the longitudinal direction of the fibers, and in this case, it is preferable that the ratio of the sectional area of thick portions to the sectional area of thin portions is 1.2 to 5. A more preferable range is 1.5 to 3. If the ratio is less than 1.2, sufficient color shade variations cannot be obtained, and the grandrelle tone can be little expressed. If more than 5, the darkly dyed portions are too intensified after dyeing, and any good appearance cannot be obtained. Furthermore, abrasion resistance declines unpreferably.

In the present invention, the respective sectional areas used for calculating the ratio of the sectional area of thick portions to the sectional area of thin portions are obtained by photographing the respective sections of the thick and thin portions of single filaments or multifilament yarn using an optical microscope.

The crystallinity is obtained from the following formula based on the yarn density measured according to the density gradient tube method.

$$Xc[\%]=[dc\times(d-da)]/[d\times(dc-da)]\times 100$$

[where the respective symbols stand for the following: Xc: crystallinity (%), d: measured yarn density (g/cm$^3$), dc: density of perfectly crystalline region (g/cm$^3$), da: density of perfectly amorphous region (g/cm$^3$)]

For example, in the case of nylon 6, dc is 1.23 g/cm$^3$ and da is 1.09 g/cm$^3$, and in the case of nylon 66, dc is 1.24 g/cm$^3$ and da is 1.09 g/cm$^3$.

As the crystallinity variations in the longitudinal direction of the fibers in the present invention, it is preferable that the difference between high crystallinity and low crystallinity is 0.5% or more. More preferable is 1.0% or more. The upper limit is not especially specified, but if the difference of crystallinity is 10% or more, the wash fastness declines and the color shade variations become too intensive unpreferably. If less than 0.5%, color shade variations cannot be manifested, and the grandrelle tone cannot be expressed unpreferably.

Fibers having structural variations in the longitudinal direction can be produced by any publicly known method, for example, by unevenly drawing undrawn polyamide yarns or heat-treating them while overfeeding from a fixed length, and drawing at room temperature, or by applying water or an aqueous liquid to the undrawn yarns intermittently and drawing them to 1.2~3 times with heating. In this case, false twisting and crimping can also be effected.

The anionic reactive dye used in the present invention generally refers to a dye having reactive groups capable of being covalently bound with hydroxyl groups and amino groups, for example, a dye having at least one or more reactive groups such as monochlorotriazine groups (X=Cl, Y=substituent group), monofluorotriazine groups (X=F, Y=substituent group), carboxypyridiniotriazine groups (X =

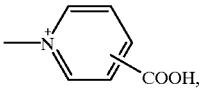

Y=substituent group), dichlorotriazine groups (X=Y=Cl), etc. respectively represented by the following formula [I], vinylsulfone groups, sulfatoethylsulfone groups, etc. respectively represented by the following formula [II], fluorochloropyrimidine groups, trichloropyrimidine groups, etc. respectively represented by the following formula [III], and bromoacrylamide groups represented by the following formula [IV]. The reactive groups are not limited to those enumerated above, and publicly known reactive groups as stated, for example, in "Kaisetu Senryo Kasgaku (Explanation of Dye Chemistry)" (in Japanese) (Shikisensha) can also be used.

The nature of the dye is not especially limited as long as it has one or more of these reactive groups. For example, a reactive dye having functional groups of the same kind, for example, two or more monochlorotriazine groups of formula [I] in the molecule or a reactive dye having functional groups of different kinds, for example, a monochlorotriazine group or monofluorotriazine group of formula [I] and a sulfatoethylsulfone group of formula [II] in the molecule can also be used. For example, a dye having a reactive group represented by the formula [I], where Y stands for a reactive group of the formula [II], can also be used.

[Formula I]

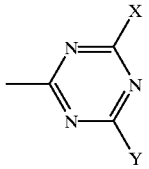

[Formula II]

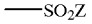

(in the formula II, Z stands for —CH═CH2 or —CH2CH2Z$^1$, and Z$^1$ stands for a leaving group such as —OSO3H, —OCOCH3, —OPO3H2 or —Cl, etc.)

[Formula III]

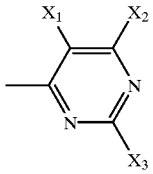

[Formula IV]

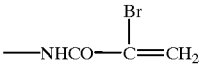

Any of the above reactive dyes allows a good grandrelle tone dyed fabric to be produced according to the method of the present invention. The sulfatoethylsulfone group, etc. represented by the formula II has a reactive group protected by a protective group, and to fix a dye having such reactive groups only by a sufficient amount in the present invention, the protective groups must be eliminated to activate the reactive groups. To perfectly eliminate these protective groups, an alkali is often necessary, and when such a dye is used in the present invention, pretreatment by an alkali is necessary before dyeing to secure sufficient dyeing property.

From this point of view, in the present invention, it is preferable to use a reactive dye having one or more groups selected from the group consisting of monochlorotriazine groups, monofluorotriazine groups, carboxypyridiniotriazine groups, dichlorotriazine groups, fluorochloropyrimidine groups, trichloropyrimidine groups and bromoacrylamide groups excellent in simplicity and reproducibility. A reactive dye having one or more of bromoacrylamide groups, monochlorotriazine groups, monofluorotriazine groups, carboxypyridiniotriazine groups and fluorochloropyrimidine groups is more preferable, since the grandrelle tone dyeing effect and/or wash fastness can be further improved while sufficient dyeing property is secured. As far as one or more of these reactive groups are contained, other reactive groups can be functional groups of any other kind such as vinylsulfone groups or sulfatoethylsulfone groups.

Dyes having these reactive groups which can be used in the present invention include those marketed under such names as Sumifix dyes (produced by Sumitomo Chemical Co., Ltd.), Sumifix Supra dyes (produced by Sumitomo Chemical Co., Ltd.), Remazol dyes (produced by Dystar K.K.), Celmazol dyes (produced by Mitsui BASF Senryo K.K.), Levafix dyes (produced by Dystar K.K.), Procion dyes (produced by Mitsui BASF Senryo K.K.), Cibacron dyes (Ciba Specialty Chemicals K.K.), Basilen dyes (produced by Mitsui BASF Senryo K.K.), Drimarene dyes (produced by Clariant K.K.), Drimalan dyes (produced by Clariant K.K.), Realan dyes (produced by Dystar K.K.), Lanasol dyes (produced by Ciba Specialty Chemicals K.K.), Kayacion dyes (produced by Nippon Kayaku Co., Ltd.), Mikacion dyes (produced by Nippon Kayaku Co., Ltd.), Kayaceron React dyes (produced by Nippon Kayaku Co., Ltd.), etc.

Among them, especially Sumifix Supra dyes (produced by Sumitomo Chemical Co., Ltd.) having a monochlorotriazine group and a vinylsulfone group (or a reactive group capable of forming a vinylsulfone group), Cibacron dyes (produced by Ciba Specialty Chemicals K.K.) having a monochlorotriazine group or a monofluororotriazine group, or a monofluorotriazine group and a vinylsulfone group (or a reactive group capable of forming a vinylsulfone group), Lanasol dyes (produced by Ciba Specialty Chemicals K.K.) having a bromoacrylamide group, Procion dyes (produced by Mitsui BASF Senryo K.K.) having a monochlorotriazine group, Kayacion dyes (produced by Nippon Kayaku Co., Ltd.) having a monochlorotriazine group, Kayaceron React dyes (produced by Nippon Kayaku Co., Ltd.) having a carboxypyridiniotriazine group, Basilen dyes (produced by Mitsui BASF Senryo K.K.) having a monochlorotriazine group, or a monochlorotriazine group and a vinylsulfone group (or a reactive group capable of forming a vinylsulfone group), Drimalan F dyes (produced by Clariant K.K.) having a fluorochioropyrimidine group, Drimarene dyes (produced by Clariant K.K.) having a fluorochloropyrimidine group, Realan dyes (produced by Dystar K.K.) having a fluorochloropyrimidine group and a vinylsulfone group (or a reactive group capable of forming a vinylsulfone group), etc. can be preferably used.

In the present invention, if a polyamide fabric having structural variations in the longitudinal direction of the fibers is dyed by a reactive dye, a grandrelle tone more intensive than that achieved by dyeing using any conventional acid dye can be expressed. The desirable grandrelle tone intensity is affected by current fashion, and it is preferable that the grandrelle tone of the same fabric can be controlled in intensity by changing the dyeing conditions. In the present invention, the grandrelle tone intensity can also be controlled by selectively using reactive dyes.

The present invention uses the advantage that a reactive dye once fixed on fibers cannot easily come off the fibers, though the dye causes such defects as irregular stripes when the reactive dye is applied to ordinary polyamide fibers. A less intensive grandrelle tone dyed fabric can be obtained by using a reactive dye having at least one or more of bromoacrylamide groups and fluorochloropyrimidine groups and also using a reactive dye not containing any monochlorotriazine group, monofluorotriazine group or carboxypyridiniotriazine group. An intensive grandrelle tone dyed fabric can be obtained by using a reactive dye having at least one or more of monofluorotriazine groups, monochlorotriazine groups and carboxypyridiniotriazine groups, more preferably a reactive dye having one or more of carboxypyridiniotriazine groups.

In the present invention, when the color is deeper, the grandrelle tone tends to be less conspicuous. However, if the reactive dyes are selectively used depending on the dye concentration, a grandrelle tone of a similar level can be obtained. For example, a medium grandrelle tone of a visually similar level can be obtained by using a reactive dye having at least one or more of bromoacrylamide groups and/or fluorochloropyrimidine groups at a dye concentration of 0.01 to 0.5% owf, a reactive dye having at least one or more of monochlorotriazine groups and/or monofluorotriazine groups at a dye concentration of 0.3 to 1.5% owf, and a reactive dye having at least one or more of carboxypyridiniotriazine groups at a dye concentration of 1.0 to 4.0% owf. Since the above concentration range depends on the preferred grandrelle tone, the range is not limited as above. Anyway the dye can be selected in reference to the order of grandrelle tone intensity. The grandrelle tone intensity can be easily controlled by selectively using reactive dyes like this.

Dyeing methods which can be used in the present invention include various publicly known methods such as dip dyeing, printing and pad dyeing. For example, dip dyeing is effected at 60-C or higher, preferably 90-C to 130-C. In the case of printing or pad dyeing, a color paste consisting of a reactive dye of the present invention and auxiliaries such as a size is prepared and applied to fibers which are then heated at 80-C to 130-C for about 10 to 30 minutes by such a heating means as wet heat treatment using saturated steam or heated steam, dry heat treatment or microwave irradiation. In the present invention, dip dyeing can be preferably used since the grandrelle effect can be clearly expressed.

In the dyeing method of the present invention, the pH of the dye liquor is regulated at 3 to 8. A preferable pH range is 4 to 7, and a more preferable range is 4 to 6, since the dye availability or the percentage of exhaustion can be improved. If the pH is in this range, even a reactive dye can sufficiently dye polyamide fibers. If the pH is less than 3, the fastness of the dyed product declines unpreferably though the percentage of exhaustion can be improved. If the pH exceeds 8, the percentage of exhaustion and/or dye availability declines not allowing a deep color to be expressed, and because of low dye availability, the waste water load increases while the economic efficiency declines.

The pH can be regulated using an acid or a properly prepared buffer. The acids, salts, etc. which can be used here are not especially limited, and include those publicly known. For example, an acid generator such as acetic acid, formic acid or hydrochloric acid can be used, and a pH sliding agent such as ammonium sulfate can also be used. The buffer which can be used can also be a buffer prepared from acetic acid and sodium acetate. Even if the dye liquor consists of a dye and water alone, the effect of the present invention can be achieved as far as the pH is in the above range.

In the present invention, to obtain the dye leveling property and reproducibility of the fabric as a whole, it is preferable to add a level dyeing agent. The level dyeing agent can be any publicly known level dyeing agent with fiber affinity and/or level dyeing agent with dye affinity. The level dyeing agents which can be used here include surfactants such as anionic surfactants, cationic surfactants, nonionic surfactants and amphoteric surfactants, inorganic salts such as Glauber's salt. As a dye leveling agent used for dyeing ordinary polyamide fibers, an anionic surfactant is general. However, in the dyeing method of the present invention, a surfactant with affinity to dyes is preferable, and especially a surfactant containing nitrogen atoms made tertiary and/or quaternary in the molecular structure can be preferably used, and an amphoteric surfactant containing anionic groups can be more preferably used. The dyed product obtained by using such a level dyeing agent is preferable in view of higher fastness, higher dye leveling property and grandrelle effect controllability. Especially in the present invention, it is preferable to add a surfactant, especially an amphoteric surfactant containing nitrogen atoms made tertiary and/or quaternary in the molecular structure, since the grandrelle effect can also be controlled. An anionic surfactant, nonionic surfactant, cationic surfactant or inorganic salt, etc. can also be used together with the amphoteric surfactant. As the amphoteric surfactant, carboxylate type, amino acid type, betaine type or sulfonate type, etc. can be used. In the present invention, especially amino acid type and/or its similar type, that is, a surfactant such as a carboxylic acid of an alkylamine and/or its semi-ester compound, etc. can be more preferably used. For example, a semi-ester compound of maleic acid or phthalic acid of an alkoxy fatty acid amine can be used, and its quaternary ammonium compound, etc. can also be used. As for the amount, an amount as much as necessary to obtain a desirable appearance can be used, and it depends on the dye used, its molecular amount and dye concentration. A preferable range is 0.01% owf to 8% owf, and a more preferable range is 0.1% owf to 5% owf. As the ratio to the amount of the dye, a preferable range is ½ to 40 times, and a more preferable range is an equal amount to 20 times. If the amount is smaller than the above range, the intended effect cannot be obtained. If larger than the above range, mass bubbling, irregularity, lower reproducibility, lower percentage of dye exhaustion, etc. are caused unpreferably.

In the present invention, after dyeing by a reactive dye, tannic acid, etc. can be used for fixing as in the case of dyeing by an acid, but to further improve fastness, it is preferable to effect soaping treatment for excluding the unfixed dye.

The soaping treatment in the present invention refers to a treatment for removing the unfixed dye or the dye likely to come off due to deposition with weak binding force, and is different from the fixing for containing the unfixed dye and the dye deposited with weak binding force into the fibers. The soaping treatment is effected preferably at pH 6 to 13, more preferably at pH 8 to 12, further more preferably at pH 10 to 12, since the unfixed dye can be removed further and since fastness can be improved. If the pH is less than 6, the wash fastness declines, and if more than 13, discoloration occurs unpreferably. It is preferable to add any publicly known surfactant, etc. to the solution regulated in said pH range, since the washing effect can be improved. The surfactant is not especially limited, and for example, an anionic surfactant, nonionic surfactant or any compound containing it, etc. can be used.

The grandrelle tone dyed polyamide product is a polyamide fabric having structural variations in the longitudinal direction of the fibers dyed by a reactive dye, and is 4th or higher grade in the wash fastness specified in JIS L-0844. It can be obtained according to the dyeing method of the present invention. It is more preferable that the dyed product is also 4th or higher grade in the light fastness specified in JIS L-0842. With regard to this property, since some dyestuffs have a problem in light fastness (e.g., Turquoise Blue dyes), care must be exercised in selecting the dye.

The dyed product obtained according to the dyeing method of the present invention and the dyed product of the present invention has the dye strongly deposited on the fibers, reacting with amino groups. So, even if the dyed product is continuously extracted with 20% pyridine aqueous solution continuously at 100-C for about 6 to 10 hours, most of the dye remains in the fabric.

The dyed product of the present invention shows a clear grandrelle tone, is excellent in wash fastness and shows a new appearance. So, it can be preferably used for various applications such as clothing and sporting goods.

The present invention is described below concretely in reference to examples.

In the examples, wash fastness and light fastness were measured according to the following standards. Furthermore, the dye concentration % owf is the wt % of the dye based on the weight of the fibers.

[Wash fastness] Contamination was judged using 9 fibers according to the A-2 method of JIS L-0844.

[Light fastness] Judged according to JIS L-0842.

The grandrelle tone intensity and the entire dye leveling property were evaluated in reference to the following four stages respectively.

Grandrelle tone intensity:

◎ . . . High ○ . . . Rather high Δ . . . Low X . . . Little

Entire dye leveling property:

◎ . . . Very good ○ . . . Good Δ . . . Rather irregular X . . . Highly irregular The fabrics used in the examples were obtained according to the following production methods.

[Fabric A producing method] Nylon 6 polymer with a relative viscosity hr of 2.63 in sulfuric acid was melt-spun at a spinning temperature of 260-C at a take-up velocity of 800 m/min, to obtain an undrawn multifilament yarn of 200 decitexes consisting of 24 filaments. The natural drawing ratio of the undrawn yarn was 2.05 times. The undrawn yarn was unevenly drawn using a drawing machine with a hot plate arranged between a feed roller and a draw roller at a feed roller speed of 300 m/min, hot plate temperature of 100-C and draw roller speed of 600 m/min (drawing ratio 2 times), to obtain a multifilament yarn of 100 decitexes consisting of 24 filaments having fiber thickness variations. The sectional area ratio of the thick portions to the thin portions of single filaments taken out of the multifilament yarn was 2.1.

The multifilament yarns were woven as warp threads and weft threads into a plain woven fabric at a weaving density of 90×75 yarns/inches, and the gray fabric was set and scoured by a stenter at 180-C, to obtain a woven fabric.

[Measurement of natural drawing ratio] An undrawn yarn as a sample was tensile-tested by Tensilon UCT-100 produced by Orienteck, and the elongation E (%) from the measurement start point to completion of necking elongation was measured. The natural drawing ratio was calculated from the following formula:

$$\text{Natural drawing ratio (times)} = 1 + (E/100)$$

[Sectional area ratio of thick portions to thin portions] The cross sections of thick portions and thin portions of each of ten single filaments taken out of a multifilament yarn were photographed using an optical microscope, and the sectional area ratios were calculated. The mean value of them was adopted as the sectional area ratio of thick portions to thin portions in the longitudinal direction of fibers. [Fabric B producing method] Nylon 6 polymer with a relative viscosity hr of 2.63 in sulfuric acid was melt-spun at a spinning temperature of 260-C and at a take-up velocity of 800 m/min, to obtain an undrawn multifilament yarn of 315 decitexes consisting of 24 filaments. The natural drawing ratio of the undrawn yarn was 2.15 times. The undrawn yarn was drawn using the same drawing machine as used for producing the fabric A at a feed roller speed of 190 m/min, hot plate temperature of 100-C and draw roller speed of 600 m/min (drawing ratio 3.15 times), to obtain a multifilament yarn of 100 decitexes consisting of 24 filaments. The crystallinity difference between thick portions and thin portions of single filaments taken from the multifilament yarn was 0.5%. The multifilament yarns were used to produce a woven fabric under the same conditions as adopted for producing the fabric A.

EXAMPLE 1

The fabric A was dyed and post-treated under the following conditions to obtain dyed fabrics 1 (dye concentration 0.2% owf) and 2 (dye concentration 2.0% owf). Their wash fastness, light fastness, grandrelle tone intensity and entire dye leveling property were evaluated, and the results are shown in Table 1.

(Dyeing conditions)

Dye: Monochlorotriazine type reactive dye, 0.2% owf and 2.0% owf, Cibacron Blue TR-E (produced by Ciba Specialty Chemicals K.K.)

Acetic acid/sodium acetate buffer: pH 5

Level dyeing agent: Anionic surfactant+nonionic surfactant mixture, Newbon TS400, 1% owf (produced by Nikka Kagaku K.K.)

Liquor ratio: 1:80

Dyeing temperature: 98-C

98-C keep time: 60 min (Post-treatment conditions)

Detergent: Granup INA-5 (produced by Sanyo Chemical Industries, Ltd.), 2 g/l

Sodium carbonate: 2 g/l

Liquor ratio: 1:80

Treatment temperature: 80-C

Treatment time: 20 min.

EXAMPLE 2

The fabric A was dyed as described for Example 1 using a different dye, and post-treated, to obtain dyed fabrics 3 (dye concentration 0.2% owf) and 4 (dye concentration 2.0% owf). Their wash fastness, light fastness, grandrelle tone intensity and entire dye leveling property were evaluated, and the results are shown in Table 1.

Dye: Vinylsulfone+monofluorotriazine bi-functional group type reactive dye, Cibacron Blue FN-R (produced by Ciba Specialty Chemicals K.K.)

EXAMPLE 3

The fabric A was dyed as described for Example 1 using a different dye, and post-treated, to obtain dyed fabrics 5 (dye concentration 0.2% owf) and 6 (dye concentration 2.0% owf). Their wash fastness, light fastness, grandrelle tone intensity and entire dye leveling property were evaluated, and the results are shown in Table 1.

Dye: Bromoacrylamide type reactive dye, Lanasol Blue 3G (produced by Ciba Specialty Chemicals K.K.)

EXAMPLE 4

The fabric A was dyed as described for Example 1 using a different dye, and post-treated, to obtain dyed fabrics 7 (dye concentration 0.2% owf) and 8 (dye concentration 2.0% owf). Their wash fastness, light fastness, grandrelle tone intensity and entire dye leveling property were evaluated, and the results are shown in Table 1.

Dye: Fluorochloropyrimidine+vinylsulfone type reactive dye, Realan Blue RC (produced by Dystar K.K.)

EXAMPLE 5

The fabric A was dyed as described for Example 1 using a different dye, and post-treated, to obtain dyed fabrics 9 (dye concentration 0.2% owf) and 10 (dye concentration 2.0% owf). Their wash fastness, light fastness, grandrelle tone intensity and entire dye leveling property were evaluated, and the results are shown in Table 1.

Dye: Carboxypyridiniotriazine type reactive dye, Kayaceron React Blue CN-MG (produced by Nippon Kayaku Co., Ltd.)

EXAMPLE 6

The fabric B was dyed and post-treated as described for 5, to obtain dyed fabrics 11 (dye concentration 0.2% owf) and 12 (dye concentration 2.0% owf). Their wash fastness, light fastness, grandrelle tone intensity and entire dye leveling property were evaluated, and the results are shown in Table 1.

EXAMPLE 7

A dyed fabric 13 was obtained by dyeing at a dye concentration of 0.2% owf as described for Example 2, and post-treating as described for Example 1. Its wash fastness, light fastness, grandrelle tone intensity and entire dye leveling property were evaluated, and the results are shown in Table 1.

Amphoteric surfactant: Arbegal B (produced by Ciba Specialty Chemicals K.K.), 1% owf

EXAMPLE 8

A dyed fabric 14 (dye concentration 0.2% owf) was obtained by adding the dye leveling agent of Example 7 by three times, i.e., 3% owf and post-treating as described for Example 1. Its wash fastness, light fastness, grandrelle tone intensity and entire dye leveling property were evaluated, and the results are shown in Table 1.

EXAMPLE 9

Dyed fabrics 15 (dye concentration 0.2% owf) and 16 (dye concentration 2.0% owf) were obtained as described for Example 2 2, except that the following conditions were adopted for post-treatment. Their wash fastness, light fastness, grandrelle Lone intensity and entire dye leveling property were evaluated, and the results are shown in Table 1.

(Post-treatment)

Nylon Fix 501 (produced by Senka K.K.): 2% owf

Liquor ratio: 1:40

Treatment temperature: 80-C

Treatment time: 20 minutes

COMPARATIVE EXAMPLE 1

The fabric A was dyed and post-treated as described for Example 9, except that an acid dye was used instead of a reactive dye, to obtain dyed fabrics 17 (dye concentration 0.2% owf) and 18 (dye concentration 2.0% owf). Their wash fastness, light fastness, grandrelle tone intensity and entire dye leveling property were evaluated, and the results are shown in Table 1.

Acid dye: Nylosan Blue N-GFL (produced by Clariant Japan K.K.)

COMPARATIVE EXAMPLE 2

The fabric B was dyed and post-treated as described for Comparative Example 1, to obtain dyed fabrics 19 (dye concentration 0.2% owf) and 20 (dye concentration 2.0% owf). Their wash fastness, light fastness, grandrelle tone intensity and entire dye leveling property were evaluated, and the results are shown in Table 1.

TABLE 1

| Dyed fabric | | Dye concentration (% owf) | Grandrelle tone intensity | Entire dye leveling property | Wash fastness (grade) Discoloration and fading | Wash fastness (grade) Contamination | Light fastness (grade) |
|---|---|---|---|---|---|---|---|
| Example 1 | Dyed fabric 1 | 0.2 | ○~◎ | ○ | 4 | 4 | ≧4 |
| | Dyed fabric 2 | 2.0 | ○ | ○ | 4~5 | 4 | ≧4 |
| Example 2 | Dyed fabric 3 | 0.2 | ○~◎ | ○ | 4~5 | 4~5 | ≧4 |
| | Dyed fabric 4 | 2.0 | ○ | ○ | 4~5 | 4 | ≧4 |
| Example 3 | Dyed fabric 5 | 0.2 | ○ | ○ | 4~5 | 4~5 | ≧4 |
| | Dyed fabric 6 | 2.0 | Δ | ○ | 4~5 | 4 | ≧4 |
| Example 4 | Dyed fabric 7 | 0.2 | ○ | ○ | 4~5 | 4 | ≧4 |
| | Dyed fabric 8 | 2.0 | Δ | ○ | 4 | 4 | ≧4 |
| Example 5 | Dyed fabric 9 | 0.2 | ◎ | ○ | 4 | 4~5 | ≧4 |
| | Dyed fabric 10 | 2.0 | ○~◎ | ○ | 4 | 4~5 | ≧4 |
| Example 6 | Dyed fabric 11 | 0.2 | ○~◎ | ○ | 4~5 | 4~5 | ≧4 |
| | Dyed fabric 12 | 2.0 | ○ | ○ | 4 | 4~5 | ≧4 |
| Example 7 | Dyed fabric 13 | 0.2 | ○~◎ | ◎ | 4~5 | 4~5 | ≧4 |
| Example 8 | Dyed fabric 14 | 0.2 | ○ | ◎ | 4~5 | 4~5 | ≧4 |
| Example 9 | Dyed fabric 15 | 0.2 | ○~◎ | ○ | 4 | 4~5 | ≧4 |
| | Dyed fabric 16 | 2.0 | ○ | ○ | 4 | 4 | ≧4 |
| Comparative Example 1 | Dyed fabric 17 | 0.2 | x~Δ | ○~◎ | 3 | 2~3 | ≧4 |
| | Dyed fabric 18 | 2.0 | x | ○~◎ | 3 | 2 | ≧4 |
| Comparative Example 2 | Dyed fabric 19 | 0.2 | x | ○~◎ | 3~4 | 3 | ≧4 |
| | Dyed fabric 20 | 2.0 | x | ○~◎ | 3~4 | 3 | ≧4 |

From the results, it can be seen that the reactive dyes of the present invention can improve the grandrelle effect and washing fastness to 4th or higher grade respectively compared to the conventionally used acid dyes. Furthermore, it can be seen that if soaping treatment is effected as post-treatment and a reactive dye having any specific reactive group is used, then fastness and/or grandrelle effect can be improved. Moreover, if reactive dyes are selectively used, the grandrelle tone intensity can be controlled. It has also been found that if an amphoteric surfactant is added, entire dye leveling property is improved, that if its amount added is changed, the grandrelle tone intensity can be controlled to provide a desired appearance. However, even if an amphoteric surfactant is used instead of an anionic surfactant as a dye leveling agent, the visual density of the dyed fabric little changed.

EXAMPLES 10~21 AND COMPARATIVE EXAMPLES 3~6

The fabric A was dyed under the following conditions, and the absorbancy of the dyeing residue at 610 nm was measured by a spectrophotometer (U-3400 produced by Hitachi, Ltd.), to calculate the percentage of exhaustion from the following formula:

Percentage of exhaustion (%)=[(Absorbancy of dye liquor before dyeing)−(Absorbancy after dyeing)]/(Absorbancy of dye liquor before dyeing)×100

Furthermore, the fabric was post-treated under the following conditions, and K/S at 640 nm was measured by a spectrophotometric calorimeter (CM-3700d produced by Minolta Co., Ltd.), to calculate the percentage of fixing from the following formula:

Percentage of fixing (%)=(K/S after post-treatment)/(K/S before post-treatment)×Percentage of exhaustion (%)

Moreover, the wash fastness of the obtained fabric was measured. The data obtained are shown in Table 2.

(Dyeing conditions)

Dye: Cibacron Blue FN-R, 0.2% and 2.0% owf
pH of dye liquor: 2, 3, 4, 5, 6, 7, 8 and 9 (regulated by formic acid, acetic acid and sodium carbonate)
Dye leveling agent: Arbegal B, 2% owf
Liquor ratio: 1:20
Dyeing temperature: 90-C
90-C keep time: 40 minutes
(Post-treatment conditions)
Granup INA-5: 2 g/l
Sodium carbonate: 2 g/l
Temperature: 80-C
80-C keep time: 20 minutes

TABLE 2

| | Dye concentration (% owf) | pH | Percentage of exhaustion (%) | Percentage of fixing (%) | Wash fastness (grade) Discoloration and fading | Wash fastness (grade) Contamination |
|---|---|---|---|---|---|---|
| Comparative Example 3 | 0.2 | 2 | 99 | 87 | 3~4 | 3~4 |
| Example 10 | 0.2 | 3 | 99 | 88 | 4 | 4 |
| Example 11 | 0.2 | 4 | 99 | 90 | 4~5 | 4~5 |
| Example 12 | 0.2 | 5 | 96 | 88 | 4~5 | 4~5 |
| Example 13 | 0.2 | 6 | 88 | 80 | 4~5 | 4~5 |
| Example 14 | 0.2 | 7 | 78 | 80 | 4~5 | 4~5 |
| Example 15 | 0.2 | 8 | 41 | 39 | 4~5 | 4~5 |
| Comparative Example 4 | 0.2 | 9 | 25 | 18 | 4~5 | 4 |
| Comparative Example 5 | 2.0 | 2 | 98 | 87 | 3 | 3 |
| Example 16 | 2.0 | 3 | 97 | 88 | 4 | 4 |
| Example 17 | 2.0 | 4 | 95 | 87 | 4~5 | 4 |
| Example 18 | 2.0 | 5 | 89 | 83 | 4~5 | 4 |
| Example 19 | 2.0 | 6 | 54 | 51 | 4~5 | 4 |
| Example 20 | 2.0 | 7 | 41 | 38 | 4 | 4 |
| Example 21 | 2.0 | 8 | 20 | 18 | 4 | 4 |
| Comparative Example 6 | 2.0 | 9 | 10 | 7 | 4 | 4 |

From the results, it can be seen that if pH is less than 3, the wash fastness declines, and that if pH is more than 8, the percentage of exhaustion is insufficient even at a low concentration of 0.2% owf, not allowing effective use of the dye.

Industrial Applicability:

The present invention can provide a polyamide fabric showing a clear grandrelle tone and having excellent wash fastness. Since it has a new appearance, it can be preferably used for various applications such as clothing and sporting goods.

What is claimed is:

1. A method for dyeing a polyamide fabric, comprising the step of dyeing a polyamide fabric having structural variations in the longitudinal direction of the fibers, by a dye liquor containing an anionic reactive dye and regulated at pH 3 to 8 wherein said structural variations are fiber thickness variations and/or crystallinity variations, wherein the fiber thickness variations are 1.2 to 5 in the sectional area ratio of thin portions to thick portions, wherein said crystallinity varies in the longitudinal direction of the fibers, and the difference in crystallinity is 0.5% to 10%, and wherein said dye liquor contains a dye leveling agent.

2. A method for dyeing a polyamide fabric, according to claim 1, wherein the dye leveling agent is a surfactant containing nitrogen atoms made tertiary and/or quaternary in the molecular structure.

3. A method for dyeing a polyamide fabric, according to claim 1, wherein said the dye leveling agent is an amphoteric surfactant.

4. A method for dyeing a polyamide fabric, according to claim 3, wherein dye leveling agent is the semi-ester of maleic acid or phthalic acid of an alkoxylated fatty acid amine.

5. A method for dyeing a polyamide fabric, according to claim 1, wherein said reactive dye has one or more of bromoacrylamide groups, monochlorotriazine groups, monofluorotriazine groups, carboxypyridiniotriazine groups and fluorochloropyrimidine groups.

6. A method for dyeing a polyamide fabric, according to claim 1, wherein the reactive groups of said reactive dyes are selectively quantified to express the grandrelle tone intensity.

7. A method for dyeing a polyamide fabric, according to claim 1, wherein soaping treatment is applied to said fabric at pH 6~13 after said dyeing step.

8. A dyed polyamide fabric, obtained by the dyeing method stated in claim 1.

9. The method defined in claim 1, wherein said reactive dye comprises one or more groups selected from the group consisting of monochlorotriazine groups, monofluorotriazine groups, carboxypyridiniotriazine groups, dichlorotriazine groups, fluorochloropyrimidine groups, trichloropyrimidine groups and bromoacrylamide groups, and wherein said dye leveling agent is a surfactant, and the amount of said surfactant is in the range of 0.01% owf to 8% owf, where "owf" means based on the weight of the fibers.

10. A dyed polyamide fabric, obtained as a grandrelle tone dyed product by dyeing a polyamide fabric having structural variations in the longitudinal direction of the fibers with a reactive dye, said fabric ranking 4th or higher grade in wash fastness.

11. A dyed polyamide fabric, according to claim 10, wherein said reactive dye includes one or more groups selected from the group consisting of bromoacrylamide groups, monochlorotriazine groups, monofluorotriazine groups, carboxypyridiniotriazine groups and fluorochloropyrimidine groups.

* * * * *